US011511461B2

(12) United States Patent
Mitsugi et al.

(10) Patent No.: US 11,511,461 B2
(45) Date of Patent: Nov. 29, 2022

(54) GLASS FILM MANUFACTURING METHOD

(71) Applicant: Nippon Electric Glass Co., Ltd., Shiga (JP)

(72) Inventors: Kaoru Mitsugi, Shiga (JP); Shuji Akiyama, Shiga (JP); Yoshinori Hasegawa, Shiga (JP)

(73) Assignee: NIPPON ELECTRIC GLASS CO., LTD., Shiga (JP)

( * ) Notice: Subject to any disclaimer, the term of this patent is extended or adjusted under 35 U.S.C. 154(b) by 637 days.

(21) Appl. No.: 16/493,358

(22) PCT Filed: Feb. 22, 2018

(86) PCT No.: PCT/JP2018/006440
§ 371 (c)(1),
(2) Date: Sep. 12, 2019

(87) PCT Pub. No.: WO2018/168381
PCT Pub. Date: Sep. 20, 2018

(65) Prior Publication Data

US 2020/0164545 A1 May 28, 2020

(30) Foreign Application Priority Data

Mar. 13, 2017 (JP) ..... JP2017-047112

(51) Int. Cl.
*B28D 7/04* (2006.01)

(52) U.S. Cl.
CPC ..... *B28D 7/04* (2013.01)

(58) Field of Classification Search
CPC ..... B28D 7/04; B65G 21/2036; B24B 7/06
See application file for complete search history.

(56) References Cited

U.S. PATENT DOCUMENTS 2,877,607 A * 3/1959 Haracz ..... B24B 7/242 451/388
3,889,801 A 6/1975 Boyer
4,804,081 A * 2/1989 Lenhardt ..... B65G 21/2036 198/689.1

(Continued)

FOREIGN PATENT DOCUMENTS

JP 3-40908 4/1991
JP 2001-142346 5/2001

(Continued)

OTHER PUBLICATIONS

International Preliminary Report on Patentability and Written Opinion of the International Searching Authority dated Apr. 10, 2018 in International (PCT) Application No. PCT/JP2018/006440.

(Continued)

*Primary Examiner* — Joel D Crandall
(74) *Attorney, Agent, or Firm* — Wenderoth, Lind & Ponack, L.L.P.

(57) ABSTRACT

Provided is a glass film manufacturing method in which manufacture-related processing is performed on a glass film while the glass film (G) is conveyed, the glass film manufacturing method comprising the step of conveying the glass film (G) on a suction roller (46), wherein the suction roller (46*a*) is configured to suck only a center portion of the glass film in a width direction of the glass film (G).

4 Claims, 4 Drawing Sheets

(56) References Cited

U.S. PATENT DOCUMENTS

| | | | | |
|---|---|---|---|---|
| 7,490,714 | B2 * | 2/2009 | Krause | B65G 49/064 414/217 |
| 2002/0020489 | A1 * | 2/2002 | Bisazza | B44C 3/123 156/269 |
| 2006/0213382 | A1 * | 9/2006 | Kanasugi | H05K 3/227 101/129 |
| 2011/0139581 | A1 * | 6/2011 | Umezawa | B65G 21/2036 198/689.1 |
| 2011/0272249 | A1 * | 11/2011 | Berni | B65H 29/003 198/612 |
| 2011/0293346 | A1 * | 12/2011 | Sato | B65H 5/38 198/689.1 |
| 2012/0017642 | A1 * | 1/2012 | Teranishi | B32B 17/10 65/273 |
| 2016/0159069 | A1 * | 6/2016 | Huang | B32B 43/006 156/707 |

FOREIGN PATENT DOCUMENTS

| | | |
|---|---|---|
| JP | 2016-155716 | 9/2016 |
| JP | 2016-196343 | 11/2016 |

OTHER PUBLICATIONS

Notification of Reason for Refusal dated Jan. 20, 2022 in corresponding Korean Patent Application No. 10-2019-7017711, with English translation.

International Search Report dated Apr. 10, 2018 in International (PCT) Application No. PCT/JP2018/006440.

* cited by examiner

GLASS FILM MANUFACTURING METHOD

TECHNICAL FIELD

The present invention relates to a glass film manufacturing method.

BACKGROUND

In general, in steps of manufacturing a glass film, manufacture-related processing such as cutting and printing is performed on the class film while the glass film is conveyed in a predetermined direction. On this occasion, in a region in which the manufacture-related processing is performed or in a periphery thereof, in some cases, the glass film is sucked and conveyed by a suction supporting mechanism, such as a belt conveyor and a roller (suction roller), driven to rotate (see, for example, Patent Literature 1). When the suction supporting mechanism is used, there are advantages in that the glass film can be conveyed while one surface thereof is in a non-contact state, and that the glass film can be stably retained even during stoppage of conveyance.

CITATION LIST

Patent Literature 1: JP 2016-196343 A

SUMMARY OF INVENTION

Technical Problem

Incidentally, the glass film does not have elasticity unlike a resin film. Accordingly, when the glass film is sucked by the suction supporting mechanism, wrinkles and flexure are liable to be formed on the glass film in a periphery of the suction supporting mechanism. The wrinkles and the flexure form relatively large protrusions on a glass surface of the glass film, and hence may cause failure of the manufacture-related processing and breakage of the glass film.

In this context, in Patent Literature 1, the following is disclosed. Specifically, in order to prevent longitudinal wrinkles extending along a conveying direction of a glass film, a base material smoothing roller is arranged on an upstream side of a suction roller, and the glass film is lifted up with the base material smoothing roller right in front of the suction roller so that the glass film is smoothed.

However, the glass film is a brittle material, and hence there is a risk in that the glass film breaks when an attempt is made to forcibly correct the wrinkles and the flexure with the base material smoothing roller. Therefore, when the risk of breakage of the glass film is taken into consideration, it is inevitable that a pressing force applied by the base material smoothing roller be set low, and hence it becomes more difficult to completely remove the wrinkles and the flexure of the glass film.

It is a technical object of the present invention to reliably suppress formation of wrinkles and flexure on a glass film while preventing breakage of the glass film when the glass film is sucked and conveyed by a supporting mechanism driven to rotate.

Solution to Problem

As a result of extensive studies, the inventors of the present invention have found out that the wrinkles and the flexure formed on the glass film during suction and conveyance are caused by a minute warp and a thickness difference that are inevitably formed at the time of forming the glass film. That is, the glass film is wavy in a width direction thereof due to a microscopic residual warp and the thickness difference. However, when the glass film is sucked by a rotary drive mechanism, the glass film tends to be deformed into a flat shape in conformity to a suction surface of the rotary drive mechanism. Accordingly, a force of forcibly correcting the warp and the thickness difference of the glass film is applied, and the warp and the thickness difference cannot be completely absorbed, with the result that the wrinkles and the flexure may be formed in a periphery of the rotary drive mechanism.

Accordingly, the present invention, which has been made based on the above-mentioned findings to solve the above-mentioned problems, has the following configuration. That is, according to one embodiment of the present invention, there is provided a glass film manufacturing method in which manufacture-related processing is performed on a glass while the glass film is conveyed, the glass film manufacturing method comprising the step of conveying the glass film on a suction supporting mechanism driven to rotate, wherein the suction supporting mechanism is configured to suck only a partial region of the glass film in a width direction of the glass film. With this configuration, the suction supporting mechanism sucks only the partial region of the glass film in the width direction. In other words, the suction supporting mechanism does not suck the entire region of the glass film in the width direction having a warp and a thickness difference. Accordingly, even when the suction supporting mechanism sucks the glass film, a shape of the glass film is not significantly corrected through a restraint of the entire region of the glass film in the width direction by the suction supporting mechanism. Therefore, without breakage of the glass formation of the wrinkles and the flexure on the glass film can be reliably prevented. Here, the "manufacture-related processing" widely encompasses processing of indirectly forming the glass film into a finished product (product ready for shipment), such as processing of cleaning a surface of the glass film and annealing processing (heat treatment) of removing distortion of the glass film, as well as processing of directly performing working on the glass film such as cutting processing, end surface working processing, processing of layering, for example, a resin film, and film formation processing including printing.

In the above-mentioned configuration, it is preferred that a width of the partial region be equal to or smaller than a half of an entire width of the glass film. With this configuration, a suction region of the glass film to be sucked can be concentrated on a narrow range of the glass film in the width direction. Accordingly, in a region other than the suction region, the glass film is not restrained but is in a natural state, thereby being capable of more reliably preventing the wrinkles and the flexure of the glass film.

In the above-mentioned configuration, it is preferred that the partial region include a center portion of the glass film in the width direction. That is, the warp and the thickness difference of the glass film, which are causes of the wrinkles and the flexure during suction and conveyance, depend on a forming method for a glass film in many cases. The warp and the thickness difference of the glass film tend to be large at both end portions of the glass film in the width direction, and tend to be small at a center portion of the glass film in the width direction. Suction and conveyance are performed only at the center portion of the glass film in the width direction in which the warp and the thickness difference are relatively small so that both end portions of the glass film in the width direction, in which the warp and the thickness difference are relatively large, are not restrained but are in a natural state. In this manner, the wrinkles and the flexure of the glass film can be more reliably prevented.

In the above-mentioned configuration, the suction supporting mechanism may comprise a belt conveyor including a suction portion only at a position corresponding to the center portion of the glass film in the width direction. With this configuration, the glass film can be supported in a stable posture on the belt conveyor. Accordingly, the manufacture-related processing can be properly performed, for example, on the belt conveyor.

In this case, the belt conveyor is divided into a plurality of belt conveyors in the width direction, and the suction portion may provided only in a center belt conveyor arranged at a center portion in the width direction among the divided belt conveyors. With this configuration, a change in widthwise dimension of the glass film is more easily coped with.

In the above-mentioned configuration, the suction supporting mechanism may comprise a suction roller including a suction portion only at a position corresponding to the center portion of the glass film in the width direction. With this configuration, stable tension can be applied to the glass film. Accordingly, the manufacture-related processing can be properly performed, for example, on an upstream side of the suction roller.

In the above-mentioned configuration, the glass film may be taken up and collected by a take-up roller after the manufacture-related processing is performed on the glass film paid out from a feed roller. With this configuration, the manufacture-related processing can be performed on the glass film by a so-called roll-to-roll system.

Advantageous Effects of Invention

According to the present invention described above, formation of wrinkles and flexure on a glass film can be reliably suppressed while preventing breakage of the glass film when the glass film is sucked and conveyed by a supporting mechanism driven to rotate.

DESCRIPTION OF EMBODIMENTS

Now, a glass film manufacturing method according to embodiments of the present invention is described with reference to the attached drawings.

First Embodiment

Figure 1:
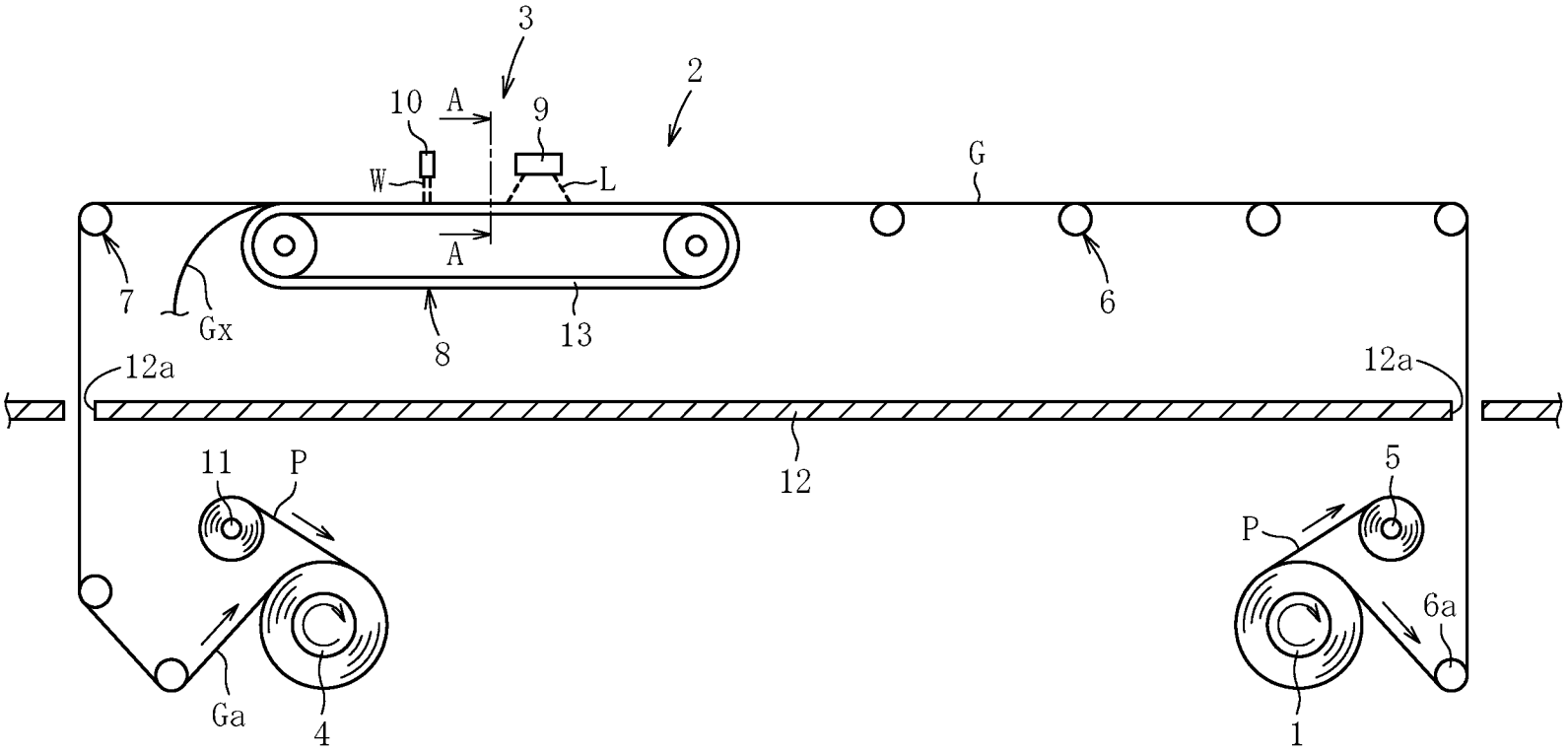
FIG. 1 is a sectional view for illustrating a glass film manufacturing apparatus, which is used for a glass film manufacturing method according to a first embodiment.

As illustrated in FIG. 1, a glass film manufacturing apparatus, which is used for a glass film manufacturing method according to a first embodiment, comprises a feed roller 1, a conveyance device 2, a cutting device 3, and a take-up roller 4. The feed roller 1 has a glass film G wound therearound. The conveyance device 2 is configured to convey the glass film G paid out from the feed roller 1. The cutting device 3 is configured to perform, as manufacture-related processing, cutting processing on the glass film G on a conveyance path of the conveyance device 2. The take-up roller 4 is configured to take up and collect the glass film G subjected to the cutting processing.

The glass film G and a protective sheet P in a layered state are wound around the feed roller 1. When the feed roller 1 is seen from a radial direction thereof, the glass film G and the protective sheet P are alternately layered. At a vicinity of the feed roller 1, an auxiliary take-up roller 5 is provided. The auxiliary take-up roller 5 is configured to separate the protective sheet P from the glass film G paid out from the feed roller 1, and to take up and collect the separated protective sheet P.

In this embodiment, the glass film G is formed by an overflow down-draw method, but the forming method is not limited thereto. For example, the glass film G may be stretched and formed by another down-draw method such as a slot down-draw method or a re-draw method, or by a float method. In the cases of those forming methods, the glass film G is formed into an elongated body extending along the stretching direction. That is, a longitudinal direction (conveying direction) of the glass film G substantially matches the stretching direction at the time of forming.

The conveyance device 2 comprises a first roller group 6, a second roller group 7, and a belt conveyor 8. The first roller group 6 and the second roller group 7 each comprise a plurality of rollers. The belt conveyor 8 is provided between the first roller group 6 on an upstream side and the second roller group 7 on a downstream side.

The first roller group 6 and the second roller group 7 are configured to guide the glass film G paid out from the feed roller 1 to the take-up roller 4 while detouring the glass film G along a substantially circular path.

The cutting device 3 is configured to carry out laser cleaving, and comprises local heating parts 9 and cooling parts 10. The local heating parts 9 are configured to perform local heating on the glass film G placed on the belt conveyor 8 by irradiating the glass film G with a laser beam L from a front surface side of the glass film G. The cooling parts 10 are configured to jet water W to a heating region heated by the local heating parts 9 from the front surface side.

When the belt conveyor 8 conveys the glass film G to the downstream side, the heating region heated by the local heating parts 9 and a cooling region cooled by the cooling parts 10 are moved on a preset cleaving line (not shown) extending along the longitudinal direction (conveying direction) of the glass film G. In this manner, thermal stress is generated by expansion resulting from heating and contraction resulting from cooling, and an initial crack (not shown) formed in advance at the beginning of the preset cleaving line propagates along the preset cleaving line. As a result, the glass film G is continuously cleaved and separated into a product portion Ga and a non-product portion Gx.

Here, a laser is used as each of the local heating parts 9, but a heating wire or another member capable of performing local heating such as hot-air jetting may be used instead. Further, each of the cooling parts 10 jets the water W as a refrigerant through use of, for example, air pressure, and the refrigerant may be liquid other than water, or gas such as the air or an inert gas. The cutting device 3 may carry out bend-breaking along a scribe line (recessed groove) formed by, for example, a diamond cutter, or may carry out laser fusing.

The glass film G and the protective sheet P in a layered state are wound around the take-up roller 4. When the take-up roller 4 is seen from a radial direction thereof, the glass film G and the protective sheet P are alternately layered. At a vicinity of the take-up roller 4, an auxiliary feed roller 11 is provided. The auxiliary feed roller 11 is configured to feed the protective sheet P that is to be layered on the glass film G taken up and collected by the take-up roller 4.

In this embodiment, the feed roller 1 and the take-up roller 4 are arranged in a lower story, and the belt conveyor 8 and the cutting device 3 are arranged in an upper story. The upper story and the lower story are partitioned by a floor 12 of the upper story (or a ceiling of the lower story), and the glass film P is moved between the upper and lower stories through an opening portion 12*a* formed in the floor 12. Accordingly, there is an advantage in that glass powder generated due to cutting by the cutting device 3 is less liable to adhere to the glass film G wound around the feed roller 1 or the take-up roller 4. It is not always required that the upper and lower stories be partitioned by the floor 12.

In this embodiment, the feed roller 1, the take-up roller 4, and the belt conveyor 8 are synchronized with each other so as to keep conveying speed of the glass film G constant. That is, the feed roller 1 is rotated in synchronization with speed of the belt conveyor 8 while maintaining shaft rotation torque for applying appropriate tension to the glass film G between the belt conveyor 8 and the feed roller 1 (in a direction of applying backward tension so as to prevent slackness of the glass film P on the upstream side of the belt conveyor 8). Further, the take-up roller 4 is also rotated in synchronization with the speed of the belt conveyor 8 while maintaining shaft rotation torque for applying appropriate tension to the glass film G between the belt conveyor 8 and the take-up roller 4 (in a direction of applying forward tension so as to prevent slackness of the glass film G on the downstream side of the belt conveyor 8).

Figure 2:
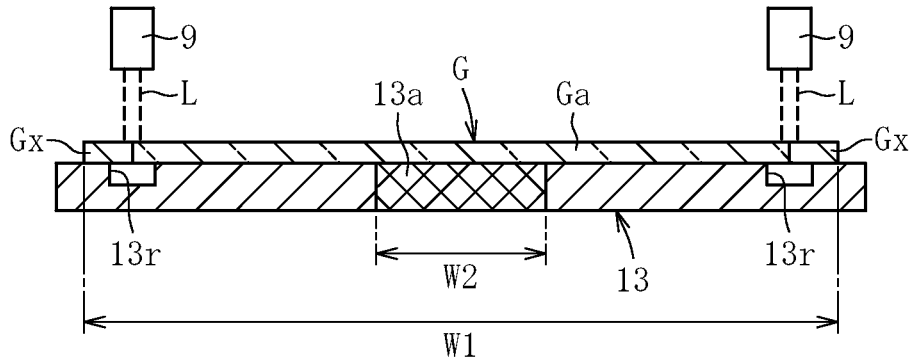
FIG. 2 is a sectional view for illustrating a belt conveyor taken along the line A-A of FIG. 1.

As illustrated in FIG. 2, a belt 13 of the belt conveyor 8 is a single continuous belt having a widthwise dimension larger than a widthwise dimension of the glass film G, and comprises a suction portion (hatched region) 13*a* only at a position corresponding to a center portion of the glass film G in a width direction thereof. Here, the width direction is a direction orthogonal to the conveying direction (the same holds true in the following description). It is preferred that a width W2 of the suction portion 13*a*, which corresponds to a suction width of the glass film G, be equal to or smaller than a half of an entire width W1 of the glass film G. It is more preferred that the width W2 of the suction portion 13*a* be equal to or larger than a tenth of the entire width W1 of the glass film G and equal to or smaller than a third of the entire width W1 of the glass film G. The belt 13 may have a widthwise dimension smaller than the widthwise dimension of the glass film G, and both ends of the glass film G in the width direction may project from the belt 13.

The belt 13 has recessed grooves 13*r* formed at positions corresponding to the preset cleaving lines of the glass film G. At the positions corresponding to the preset cleaving lines, the recessed grooves 13*r* allow a back surface of the glass film G to be held in non-contact with the belt 13. As a result, heat applied to the glass film G at the time of cleaving through use of the laser beam L or the water W is less liable to escape to the belt 13 side, thereby being capable of efficiently applying thermal stress on the glass film G. The recessed grooves 13*r* may be omitted.

Next, description is made of a glass film manufacturing method, which uses the glass film manufacturing apparatus having the above-mentioned configuration.

As illustrated in FIG. 1, in the glass film manufacturing method according to the first embodiment, as the manufacture-related processing, the cutting processing (trimming) is performed on the glass film G while the glass film G is conveyed. The cutting processing is performed on the glass film G by a roll-to-roll system.

Specifically, after the glass film G paid out from the feed roller 1 is conveyed by the first roller group 6, the glass film G is sequentially cut on the belt conveyor 8 along the preset cleaving lines each formed on a boundary between the product portion Ga and the non-product portion Gx. The non-product portion Gx is separated from the product portion Ga after the cutting, and is crushed and collected at a position away from the product portion Ga. The product portion Ga is taken up and collected by the take-up roller 4 after the product portion Ga is conveyed by the second roller group 7. As illustrated in FIG. 2, the non-product portion Gx is formed at each end portion of the glass film G in the width direction. In some cases, a thickness of the non-product portion Gx is larger than a thickness of the product portion Ga. Instead of or in combination with cutting and removing the non-product portion, the product portion may be cut on the belt conveyor 8 into two or more pieces in the width direction, and then the cut pieces may be taken up and collected by different take-up rollers individually.

As illustrated in FIG. 2, on the belt conveyor 8, only the center portion of the glass film G in the width direction (part of the product portion Ga) in which a warp and a thickness difference tend to be small is sucked by the suction portion 13*a*. In other words, each end portion of the glass film G in the width direction (including the non-product portion Gx) in which a warp and a thickness difference tend to be large is not sucked by the suction portion 13*a*, but is merely placed on the belt conveyor 8. That is, relative movement caused by, for example, sliding is allowed between each end portion of the glass film G in the width direction and the belt conveyor 8. Accordingly, even when the glass film G is sucked by the suction portion 13*a*, a shape of the glass film G (in particular, a shape of each end portion of the glass G in the width direction) is not significantly corrected. Therefore, breakage, wrinkles, and flexure, which may be caused by forcible correction of the shape of the glass film G, can be prevented. Thus, misalignment and improper application of stress are less liable to occur at a position of cutting the glass film G, thereby being capable of cutting the glass film G accurately.

Second Embodiment

A glass film manufacturing apparatus, which is used for a glass film manufacturing method according to a second embodiment, is different from the configuration of the first embodiment in a configuration of the belt conveyor. In the following, the configuration of the belt conveyor being the difference from the first embodiment is mainly described. The configuration other than the belt conveyor is the same as that in the first embodiment, and hence detailed description thereof is omitted.

Figure 3:
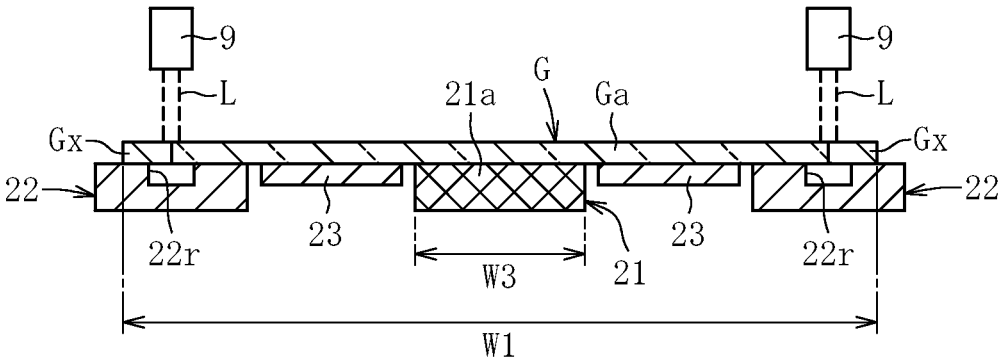
FIG. 3 is a sectional view for illustrating a belt conveyor of a glass film manufacturing apparatus, which is used for a glass film manufacturing method according to a second embodiment.

In the second embodiment, as illustrated in FIG. 3, the belt conveyor 8 is divided into a plurality of belt conveyors in the width direction. A suction portion (hatched region) 21*a* configured to suck the glass film G is provided in a partial region or an entire region of a belt (also referred to as "center belt") 21 of a center belt conveyor at a center portion of the belt conveyor 8 in the width direction. Meanwhile, the suction portion is not provided in a belt (also referred to as "side belt") 22 of a side belt conveyor at each end portion of the belt conveyor 8 in the width direction. It is preferred that a width W3 of the suction portion 21*a* be equal to or smaller than a half of the entire width W1 of the glass film G. It is more preferred that the width W3 of the suction portion 21*a* be equal to or larger than a tenth of the entire width W1 of the glass film G and equal to or smaller than a third of the entire width W1 of the glass film G.

A recessed groove 22*r* is formed in the side belt 22 at a position corresponding to the preset cleaving line of the glass film G. The recessed groove 22*r* is configured to efficiently apply thermal stress on the glass film G at the time of cleaving similarly to the recessed groove 13*r* in the first embodiment. The recessed groove 22*r* may be omitted.

A plate-like body 23 elongated in the conveying direction is arranged between the center belt 21 and each of the side belts 22. The glass film G is supplementarily supported by the plate-like body 23 between the center belt 21 and each of the side belts 22. When the glass film G is conveyed under this state, the glass film G slides on the plate-like bodies 23. The plate-like bodies 23 may be omitted. Further, there may be adopted a configuration of supplementarily supporting the glass film G by a fluid such as gas or liquid in place of the plate-like bodies 23. Further, in view of preventing breakage of the glass film G such as a flaw, it is preferred that the plate-like bodies 23 be made of a resin material such as polyethylene, nylon, or Teflon (registered trademark).

The number of division of the belt conveyor 8 in the width direction and an distance between divided belt conveyors may be changed as appropriate. The divided belt conveyors may be configured to be movable in the width direction so that the distance between the belt conveyors can be adjusted.

Third Embodiment

A glass film manufacturing apparatus, which is used for a glass film manufacturing method according to a third embodiment, is different from the configurations of the first embodiment and the second embodiment in a configuration of a feed unit for the glass film. In the following, the configuration of the feed unit for the glass film being the difference from the first embodiment and the second embodiment is mainly described. The configuration other than the feed unit for the glass film is the same as those in the first embodiment and the second embodiment, and hence detailed description thereof is omitted.

Figure 4:
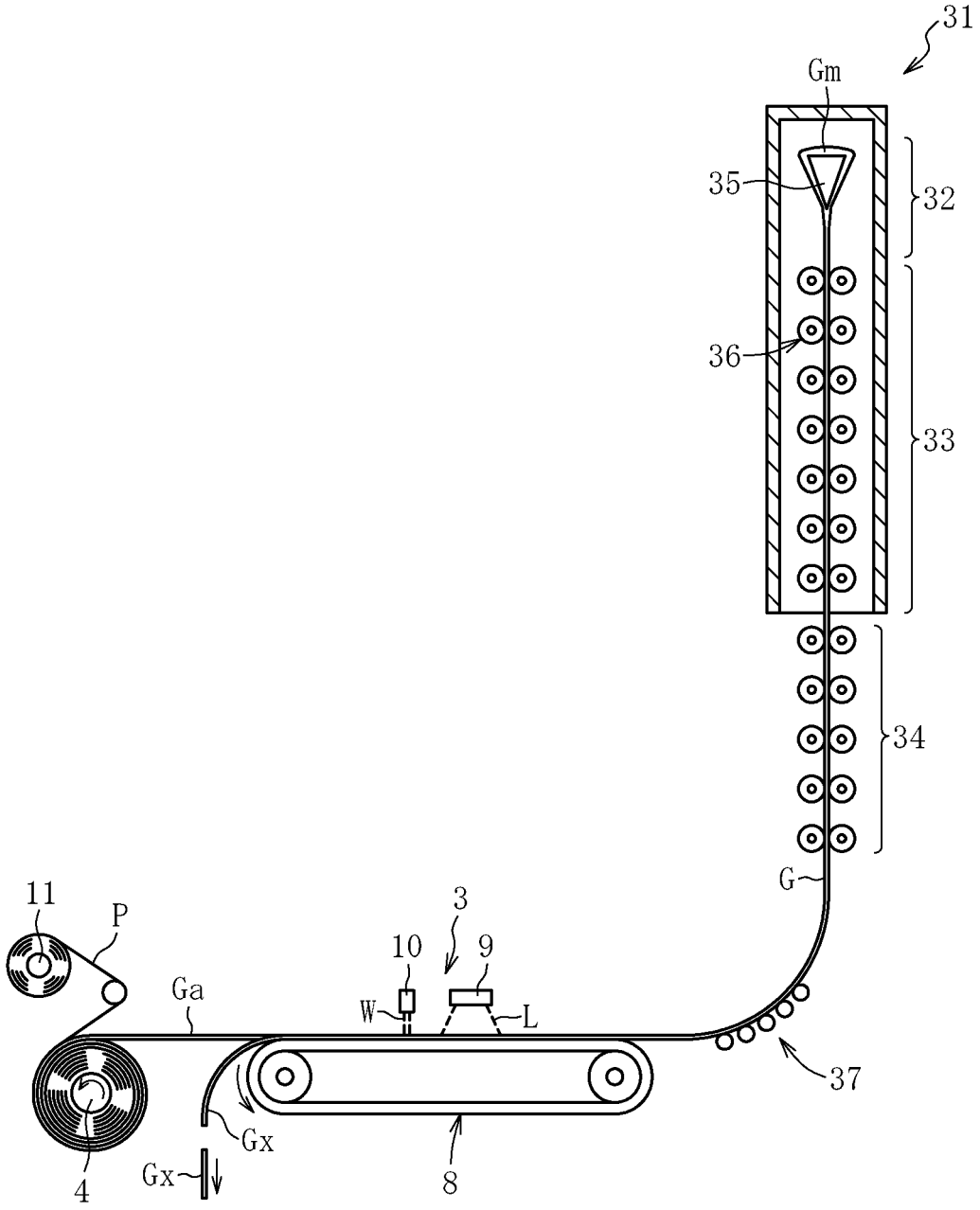
FIG. 4 is a sectional view for illustrating a glass film manufacturing apparatus, which is used for a glass film manufacturing method according to a third embodiment.

In the third embodiment, as illustrated in FIG. 4, the glass film G is directly fed from a forming device 31. The forming device 31 is configured to carry out the overflow down-draw method, and comprises a forming furnace 32, an annealing furnace 33, and a cooling region 34, which are arranged in the stated order from an upper side of the forming device 31. The forming device 31 is not limited to a device configured to carry out the overflow down-draw method, but may carry out, for example, another down-draw method or a float method.

In the forming furnace 32, a molten glass Gm is fed into a forming trough 35 having a wedge-shaped sectional shape, and the molten glass Gm having overflowed from a top to both sides of the forming trough 35 is merged at a lower end portion of the forming trough 35 so as to flow downward. In this manner, the sheet-like glass film G is continuously formed from the molten glass Gm. The glass film G is gradually increased in viscosity as moving downward. After the glass film G reaches a viscosity high enough to maintain its shape, distortion of the glass film G is removed in the annealing furnace 33, and the glass film G is cooled in the cooling region 34 to a temperature approximate to room temperature.

In the annealing furnace 33 and the cooling region 34, a plurality of roller groups 36 each comprising a pair of rollers are arranged at a plurality of positions from the upstream side to the downstream side of the conveyance path of the glass film G, and are configured to guide both end portions of the glass film G in the width direction downward. In this embodiment, the uppermost rollers arranged in the forming device 31 function as cooling rollers (edge rollers) configured to cool both end portions of the glass film G in the width direction, and also function as drive rollers configured to draw the glass film G downward. Meanwhile, the remaining rollers arranged in the forming device 31 function as, for example, idle rollers and tension rollers configured to guide the glass film G downward.

The glass film G is curved substantially in a horizontal direction by a posture changing roller group 37 comprising a plurality of rollers configured to support the glass film G from below at positions below the forming device 31. After that, while maintaining the posture, the glass film G is conveyed to the belt conveyor 8 on which the cutting processing is to be performed. The posture changing roller group 37 may be omitted. As a specific configuration of the belt conveyor 8, the configuration described in the first embodiment or the configuration described in the second embodiment may be adopted.

Fourth Embodiment

Figure 5:
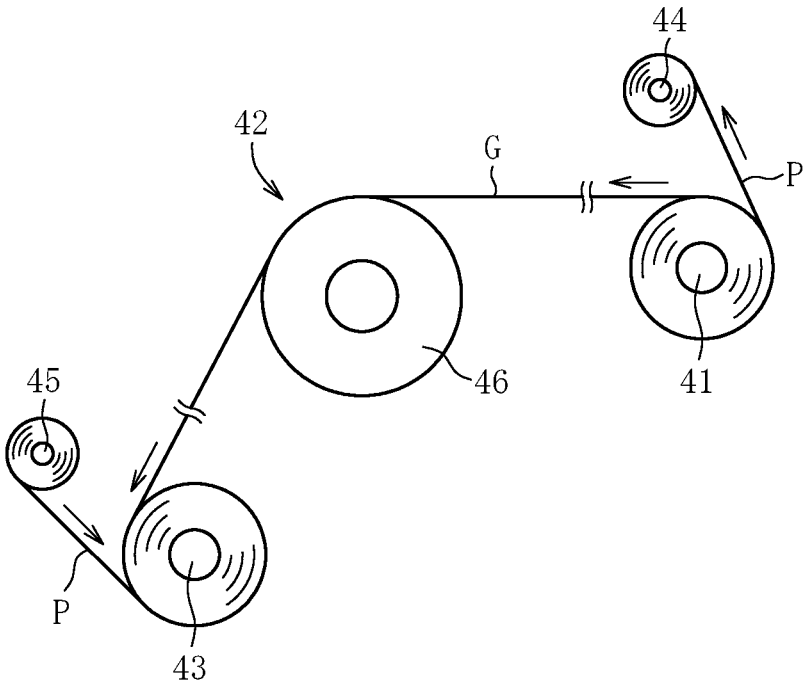
FIG. 5 is a side view for illustrating a main part of a glass film manufacturing apparatus, which is used for a glass film manufacturing method according to a fourth embodiment.

As illustrated in FIG. 5, a glass film manufacturing apparatus, which is used for a glass film manufacturing method according to a fourth embodiment, comprises a feed roller 41, a conveyance device 42, a printing device (not shown), and a take-up roller 43. The feed roller 41 has a glass film G wound therearound. The conveyance device 42 is configured to convey the glass film G paid out from the feed roller 41. The printing device is configured to perform, as manufacture-related processing, printing processing on the glass film G on a conveyance path of the conveyance device 42. The take-up roller 43 is configured to take up and collect the glass film G subjected to the printing processing.

Similarly to the first embodiment, at a vicinity of the feed roller 41, an auxiliary take-up roller 44 configured to take up and collect the protective sheet P is provided. At a vicinity of the take-up roller 43, an auxiliary feed roller 45 configured to feed the protective sheet P is provided.

The conveyance device 42 comprises a roller group (not shown) comprising a plurality of rollers, and a suction roller 46.

The suction roller 46 is configured to suck an unprinted surface of the glass film G subjected to the printing processing (for example, screen printing) on the upstream side of the suction roller 46. The suction roller 46 is intermittently rotated together with the feed roller 41 and the take-up roller 43. Specifically, the rollers 41, 43, and 46 are temporarily stopped after feeding the glass film G having a predetermined length to a printing step, and are rotated again after completion of the printing processing, to thereby feed the new glass film G to the printing step.

In this embodiment, the feed roller 41, the take-up roller 43, and the suction roller 46 are synchronized with each other so as to keep conveying speed of the glass film G constant. That is, the feed roller 41 is rotated in synchronization with speed of the suction roller 46 while maintaining shaft rotation torque for applying appropriate tension to the glass film G between the suction roller 46 and the feed roller 41 (in a direction of applying backward tension so as to prevent slackness of the glass film G on the upstream side of the suction roller 46). Further, the take-up roller 43 is also rotated in synchronization with the speed of the suction roller 46 while maintaining shaft rotation torque for applying appropriate tension to the glass film G between the suction roller 46 and the take-up roller 4 (in a direction of applying forward tension so as to prevent slackness of the glass film G on the downstream side of the suction roller 46).

Figure 6:
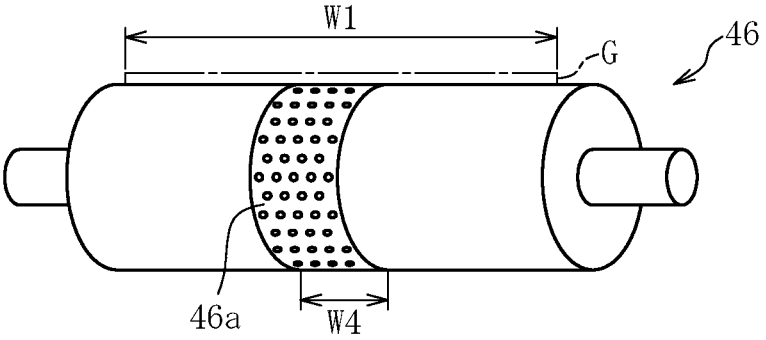
FIG. 6 is a perspective view for illustrating a suction roller illustrated in FIG. 5.

As illustrated in FIG. 6, the suction roller 46 comprises a suction portion 46*a* configured to suck the glass film G. The suction portion 46*a* is provided only at a position corresponding to the center portion of the glass film G in the width direction. It is preferred that a width W4 of the suction portion 46*a* be equal to or smaller than a half of the entire width W1 of the glass film G. It is more preferred that the width W4 of the suction portion 46*a* be equal to or larger than a tenth of the entire width W1 of the glass film G and equal to or smaller than a third of the entire width W1 of the glass film G.

With the above-mentioned configuration, on the suction roller 46, only the center portion of the glass film G in the width direction is sucked by the suction portion 46*a*. On the suction roller 46, only the center portion of the glass film in the width direction in which a warp and a thickness difference tend to be small is sucked by the suction portion 46*a*. In other words, each end portion of the glass film G in the width direction in which a warp and a thickness difference tend to be large is not sucked by the suction portion 46*a*, but is merely wound around the suction roller 46. That is, relative movement caused by, for example, sliding is allowed between each end portion of the glass film G in the width direction and the belt conveyor 8. Accordingly, even when the glass film G is sucked by the suction portion 46*a*, a shape of the glass film G (in particular, a shape of each end portion of the glass film G in the width direction) is not significantly corrected. Therefore, breakage, wrinkles, and flexure, which may be caused by forcible correction of the shape of the glass film G, can be prevented. Thus, misalignment of a printing pattern is less liable to occur at the time of the printing processing, thereby being capable of performing accurate printing on the glass film G.

The present invention is not limited to the configurations of the above-mentioned embodiments. In addition, the action and effect of the present invention are not limited to those described above. The present invention may be modified in various forms within the range not departing from the spirit of the present invention.

In the above-mentioned embodiments, description is made of the case in which the manufacture-related processing (cutting processing) is performed on the belt conveyor. However, the manufacture-related processing may be performed on the upstream side or the downstream side of the belt conveyor. Further, in the above-mentioned embodiments, description is made of the case in which the manufacture-related processing (printing processing) is performed on the upstream side of the suction roller. However, the manufacture-related processing may be performed on the suction roller or the downstream side of the suction roller.

In the above-mentioned embodiments, description is made of the case in which the glass film subjected to the manufacture-related processing is taken up and collected by the take-up roller. However, the glass film subjected to the manufacture-related processing may be cut into pieces each having a predetermined length so as to be formed into sheets. In this case, the sheet-like cut glass films are sequentially layered on a pallet in an upright posture or a laid posture, and are packed.

In the above-mentioned embodiment, description is made of the case in which only the center portion of the glass film in the width direction is sucked. However, only a partial region offset from the center portion of the glass film in the width direction may be sucked. Also in this case, a preferable width of the suction portion is set in the same manner as those in the above-mentioned embodiments.

REFERENCE SIGNS LIST

1 feed roller
2 conveyance device
3 cutting device
4 take-up roller
5 auxiliary take-up roller
6 first roller group
7 second roller group
8 belt conveyor
9 local heating part
10 cooling part
11 auxiliary feed roller
12 floor
13 belt
13*a* suction portion
13*r* recessed portion
21 belt of center belt conveyor
21*a* suction portion
22 belt of side belt conveyor
22*r* recessed portion
23 plate-like body
31 forming device
32 forming furnace
33 annealing furnace
34 cooling region
35 forming trough
36 roller group
37 posture changing roller group
41 feed roller
42 conveyance device
43 take-up roller
44 auxiliary take-up roller
45 auxiliary feed roller
46 suction roller
46*a* suction portion
G glass film
P protective sheet
L laser beam
W water

The invention claimed is:

1. A glass film manufacturing method comprising a cutting step of cutting a glass film with a cutting device while conveying the glass film, wherein, in the cutting step, a belt conveyor having a suction portion only at a position corresponding to a center portion of the glass film in a width direction is arranged on an upstream side of the cutting device, and wherein, in the cutting step, the glass film is supplied to the cutting device by the belt conveyor while the suction portion sucks only the central portion of the glass film in the width direction so that wrinkles of the glass film in the cutting device are suppressed.

2. The glass film manufacturing method according to claim 1, wherein the width of the suction portion is equal to or smaller than a half of an entire width of the glass film.

3. The glass film manufacturing method according to claim 1, wherein the belt conveyor is divided into a plurality of belt conveyors in the width direction, and wherein the suction portion is provided only in a center belt conveyor arranged at a center portion in the width direction among the divided belt conveyors.

4. The glass film manufacturing method according to claim 1, wherein the glass film is taken up and collected by a take-up roller after the cutting.

* * * * *